United States Patent [19]

Goldfarb et al.

[11] 4,039,188

[45] Aug. 2, 1977

[54] TOY AIRCRAFT ACTION SKILL GAME

[75] Inventors: Adolph E Goldfarb, Tarzana; Erwin Benkoe, Encino; Delmar K Everitt, Woodland Hills; Ronald F. Chesley, La Crescenta; Richard D. Frierdich, Canoga Park, all of Calif.

[73] Assignees: A. E. Goldfarb; Erwin Benkoe, both of Northridge, Calif.

[21] Appl. No.: 613,354

[22] Filed: Sept. 15, 1975

[51] Int. Cl.[2] ..... A63F 9/02

[52] U.S. Cl. ..... 273/101; 273/102 AP; 273/102.1 E; 273/127 D

[58] Field of Search ..... 273/95 R, 101, 101.1, 273/101.2, 102.2 R, 102.1 R, 102.1 C, 103, 119 R, 120 R, 85 R, 128 R, 102 AP, 127 D, 102.1 E

[56] References Cited

U.S. PATENT DOCUMENTS

| | | | |
|---|---|---|---|
| 151,410 | 5/1874 | Marshall | 273/119 R |
| 1,929,327 | 10/1933 | Moray | 273/101 |
| 2,617,653 | 11/1952 | Keller | 273/103 |
| 3,724,854 | 4/1973 | Brooks | 273/101.1 |
| 3,891,216 | 6/1975 | Ensmann | 273/102.1 C |
| 3,897,952 | 8/1975 | Breslow | 273/127 D X |
| 3,899,170 | 8/1975 | Parks et al. | 273/127 D X |
| 3,936,052 | 2/1976 | Hornsby | 273/101 |

*Primary Examiner*—Richard J. Apley
*Assistant Examiner*—Vance Y. Hum
*Attorney, Agent, or Firm*—Robert M. Ashen; Robert J. Schaap

[57] ABSTRACT

An action skill game including a game board with a pair of simulated aircraft shiftably mounted on the game board at each of the opposite ends thereof and each of which are operated by opponent players. The simulated aircraft are carried by a shiftable carrier mechanism which is also provided with a projectile shooting mechanism and which carrier mechanism also enables "transverse movement" of the aircraft relative to the game board and "pivotal movement" relative to the game board and the shooting mechanism. Each of the shooting mechanisms are provided with control sticks so that the opponent players can manuever the simulated aircraft as well as shoot projectiles at the other simulated aircraft. Each of the particular simulated aircraft employ a pair of moveable target elements which will shift rearwardly with respect to the fuselage of the aircraft when hit by a projectile from the opposite simulated aircraft. When both of the pair of targets on a particular aircraft have been hit and shifted, by the projectiles, a release mechanism permits the plane to pivot downwardly thereby simulating a damaged aircraft.

14 Claims, 12 Drawing Figures

10
16
20
22
24
26
28
30
32
34
36
38
48
50
52
56
58
60
62
64
66
68
72
74
76
78
82
83
90
92
94
95
96
98
100

52
48
50
32
16
38
42
44
46
36
26
30
28
22
24
104
106
34
54
108
56
110
66
60
64
58
68
62
90
103
57
83
82
9
112
80
84
99
98
96
95
70
72

TOY AIRCRAFT ACTION SKILL GAME

BACKGROUND OF THE INVENTION

This invention relates in general to certain new and useful improvements in airplane action skill games, and more particularly, to airplane action skill games in which two opponent players may maneuver simulated aircraft and attempt to shoot projectiles at the opposing aircraft in order to score specific target hits.

There have been several action skill simulated toy games in which one simulated player element attempts to score a target hit against an opposing simulated player element. One particular game of this type employs a pair of simulated cowboy-type characters, each having handguns, and which characters are shiftable transversely on arcuately shaped transversely extending guide rails at each of opposed player ends on a game board. Each of the opposing players will attempt to shift the characters with the guns transversely along the guide shaped rails to a desired position and thereupon shoot the guns and release a projectile such as a small ball in order to effect a hit on the character associated with the opposing player. If the one player does achieve a hit, the simulated cowboy character moves and the opponent player who fired the projectile acquires a score point.

There are several disadvantages with this form of simulated action skill toy game in that the shooting mechanisms as for example the simulated guns are only swingable along an arcuate plane in the transverse direction and are not as maneuverable as would be desired in order to simulate the actual movement of a handgun. Another draw back of this type of action-skill game is that only one projectile hit is required in order to effect a score which thereby effectively diminishes the skill required, due to the fact that these action-skill games which attempt to simulate an accurate representation of a real life or form of real life situation are seriously limited in the simulation thereof. Thus, the children playing such games tend to loose interest rather quickly.

The present invention obviates these and other problems in the provision of a toy action-skill game employing simulated aircraft in which the aircraft are both transversely and pivotally moveable at opposite end of a player game board. Moreover, each of the simulated aircraft employ a pair of opposed spaced apart targets so that one player might effect two scores, that is by firing a projectile, in the form of a small steel ball, and hit each of the targets on the opposing player's simulated aircraft for achieving a score point. Moreover, the simulated aircraft are mounted with respect to the shooting mechanisms in such a manner that the front end of the simulated aircraft will pivot downwardly when both targets have been hit, thereby more realistically simulating an aircraft which has been shot and is in or heading toward a crash position.

It is therefore the primary object of the present invention to provide an action skill simulated aircraft toy game in which a pair of simulated aircraft are moveable transversely and pivotally on each of the opposite ends of a playing board and are capable of issuing projectiles toward the opposed aircraft for scoring target hits.

It is another object of the present invention to provide a game in which simulated aircraft are mounted in such a manner that they will pivot downwardly when struck by projectiles so as to more accurately simulate an actual aircraft which has been damaged.

It is further the object of the present invention to provide a game of the type stated which is relatively durable in its construction, and which can be manufactured at a relatively low unit cost.

It is an additional object of the present invention to provide a game of the type stated in which both of the simulated aircraft are both transversely and pivotally moveable.

With the above and other objects in view, our invention resides in the novel feature of the form, construction, arrangement, and combination of parts presently described and pointed out in the claims.

GENERAL DESCRIPTION

The present invention relates to new and useful improvements in an action-skill game which employ simulated aircraft. In this case, the action-skill game includes a game board with means defining opposed opponent player ends at each of the opposite ends of the game board. A carrier means is operatively mounted at each of the opposite player ends. Moreover, a simulated three-dimensional aircraft is operatively mounted on each of the carrier means. In this case, the simulated aircraft is transversely shiftable and also pivotable in a plane normal to the game board. In more specific detail, the three-dimensional simulated aircraft is shiftable transversely with the carrier means and is pivotable on the carrier means in a plane relatively normal to the game board.

A projectile shooting mechanism is operatively associated with each of the carrier means for issuing a projectile toward the opponent player's simulated aircraft. A pair of spaced-apart target elements are mounted on each of the simulated aircraft. Target effect means are associated with each of the simulated aircraft causing the simulated aircraft to depict a projectile struck aircraft only when both of the spaced apart target elements on the aircraft have been struck by a projectile issuing from the shooting mechanism of the opponent player.

The present invention can be described in further detail in that the projectiles may be small metal spherical elements, preferably in the form of small steel balls.

The target effect means includes means to permit the simulated aircraft to pivot toward the game board relatively perpendicular to the normal surface thereof when both the spaced-apart target elements have been struck by a projectile. More specifically, the front end of the simulated aircraft pivots downwardly toward the game board when both such target elements have been struck by the projectile.

In a preferred aspect of the present invention, the game board is tapered downwardly toward each of the player ends such that the projectiles issued from either of the shooting mechanisms may roll toward either of the player ends. Moreover, a trough means is located at each of the player ends to accumulate the projectiles.

As a more preferred aspect of the present invention, a particular shooting mechanism is associated with each carrier means and is directionally pivotable with such simulated aircraft associated with the carrier means. In this way, the projecticle issuing from the associated aircraft is directionally oriented with the simulated aircraft. In addition, wheels are mounted on each of the simulated aircraft and these wheels pivot outwardly on the front end of the simulated aircraft pivoting downwardly, when each of the target elements of the aircraft have been struck by the projectiles.

BRIEF DESCRIPTION OF DRAWINGS

Figure 1:
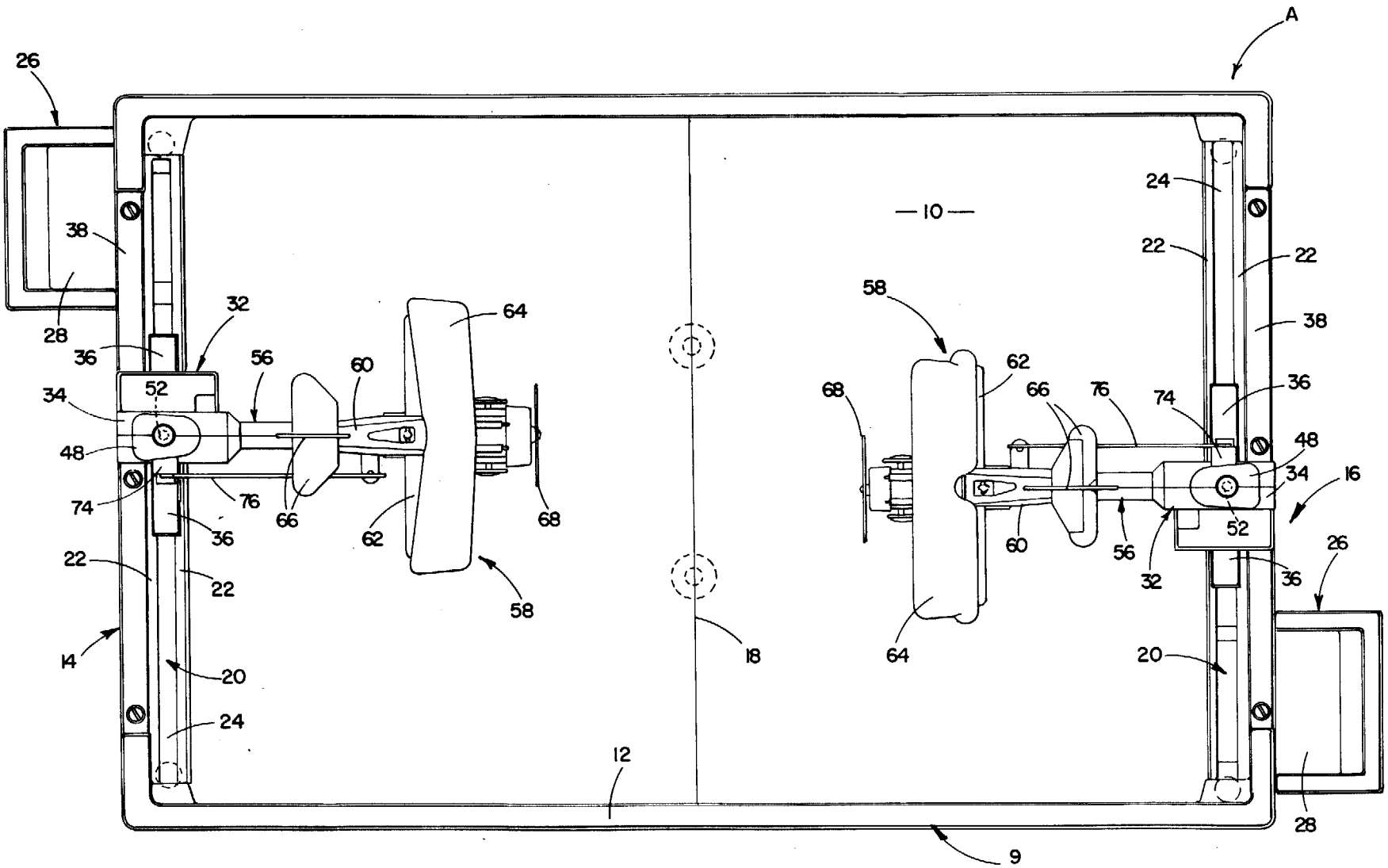
Figure 2:
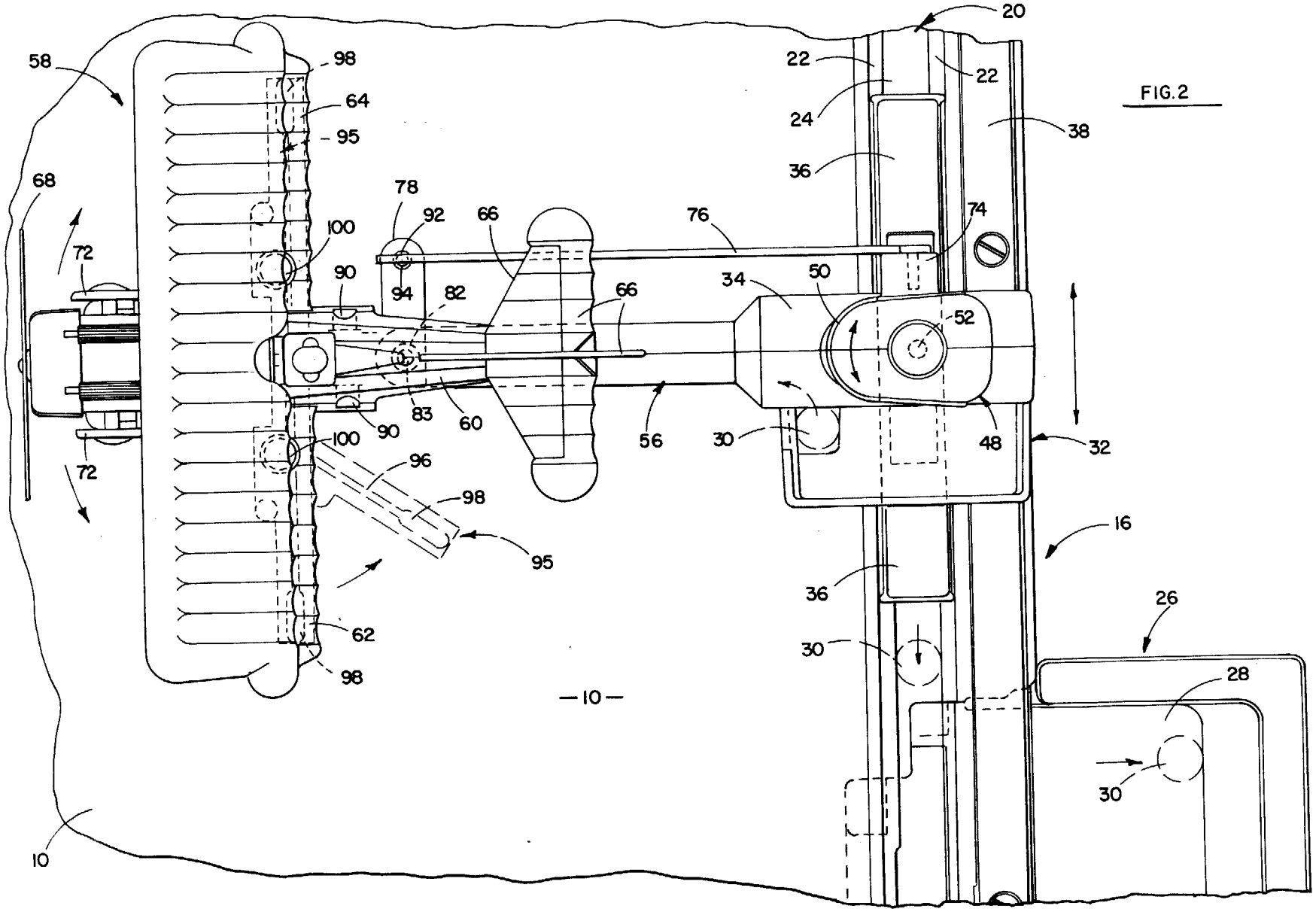
Figures 3, 9:
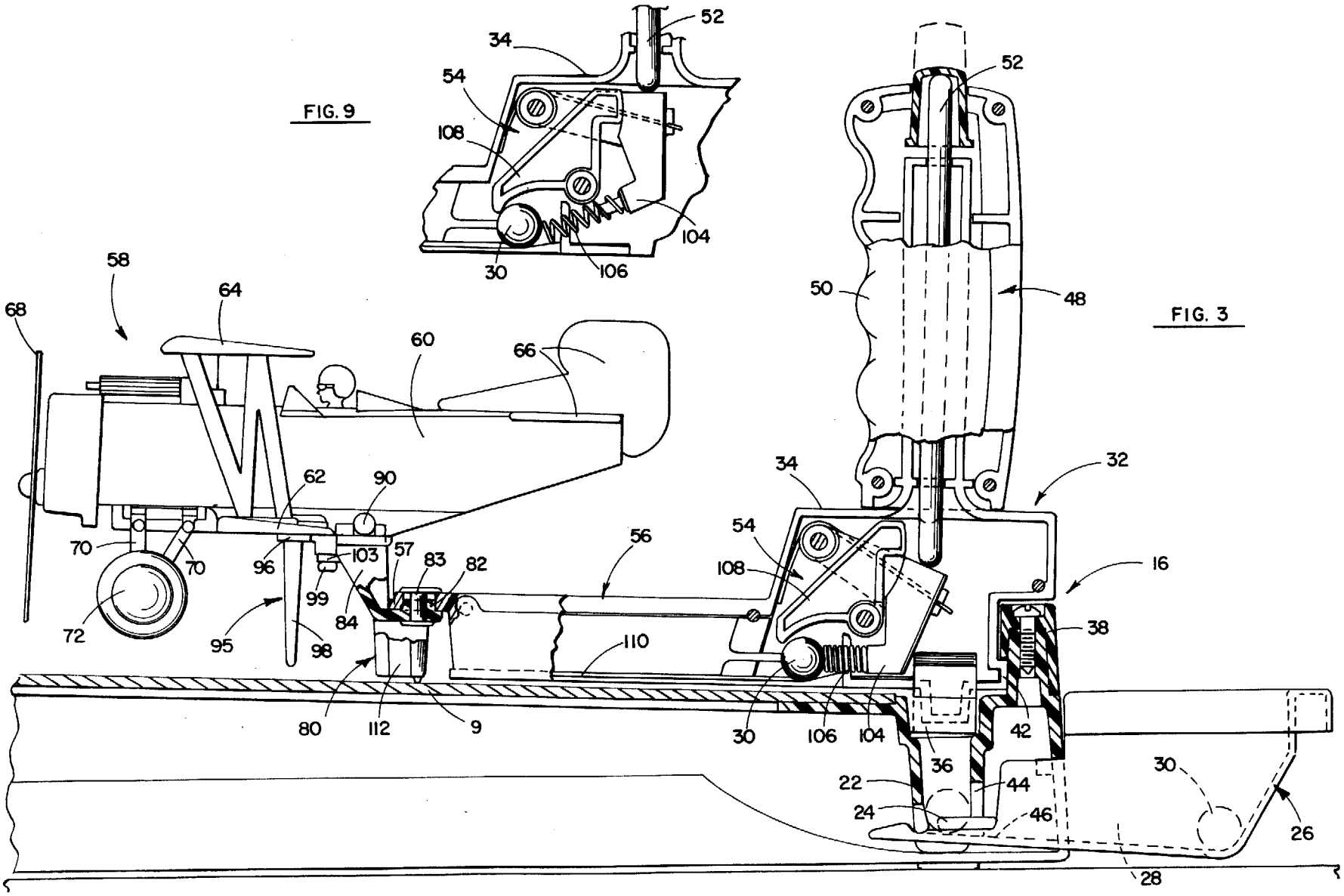
Figure 5:
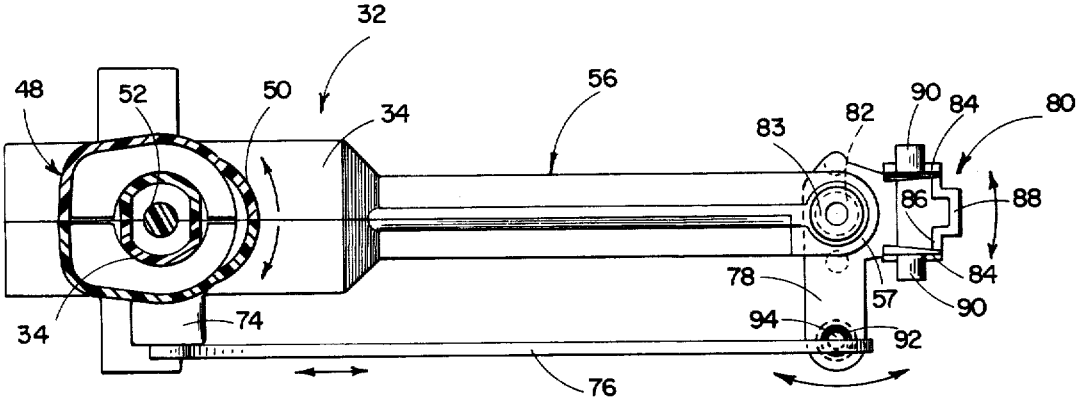
Figure 4:
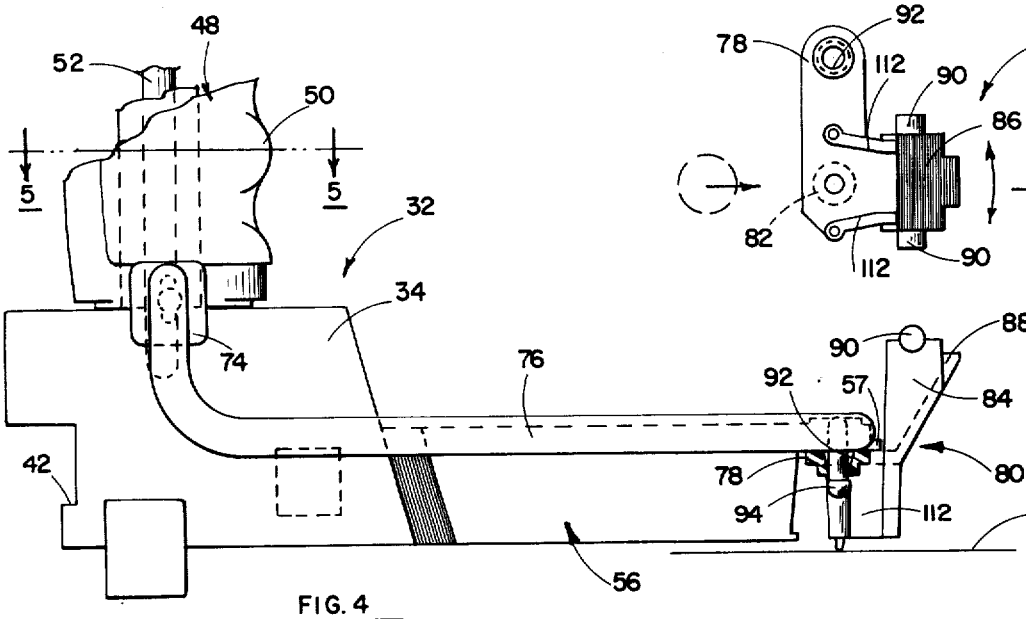

Having thus described the invention in general terms, reference will now be made to the accompanying drawings in which:

FIG. 1 is a top plan view of a toy game apparatus constructed in accordance with and embodying the present invention;

FIG. 2 is an enlarged fragmentary top plan view, and showing one of the player ends of the game apparatus of the present invention;

FIG. 3 is a vertical sectional view showing the details of construction of the shooting mechanism and carrier mechanism at the player end illustrated in FIG. 2;

FIG. 4 is a rear side elevational view, partially in section, showing a part of the shooting mechanism and the projectile deflector controls forming part of the apparatus of the present invention;

FIG. 5 is a top plan view, partially in section, and showing the shooting mechanism and part of a projectile deflector control mechanism forming part of the apparatus of the present invention as indicated by section line 5—5 of FIG. 4.

Figure 6:
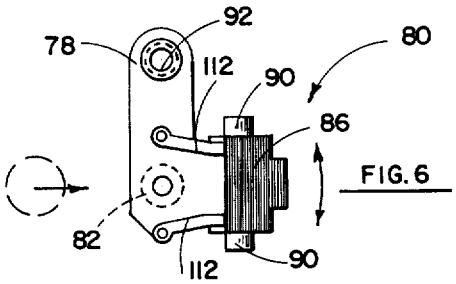
Figure 7:
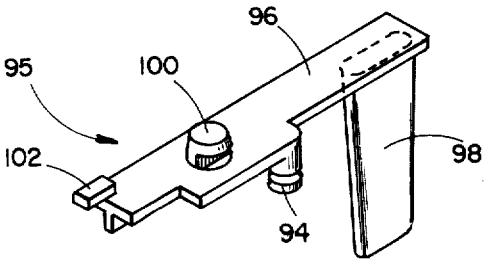
Figure 8:
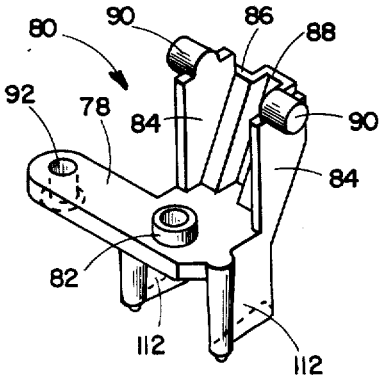
Figure 10:
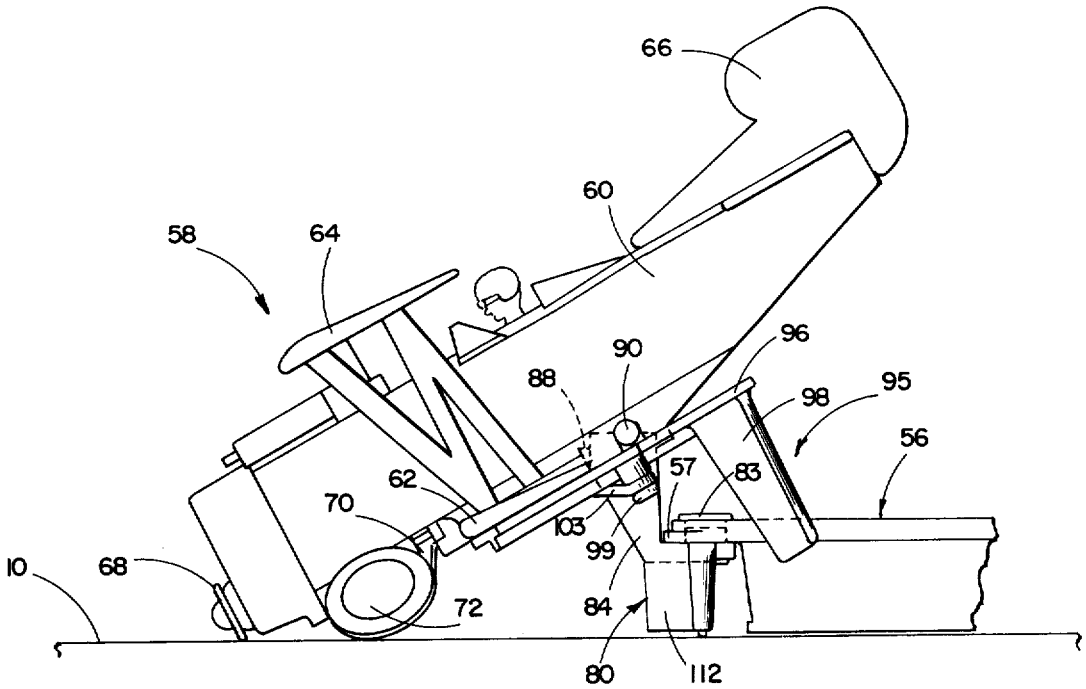
Figure 11:
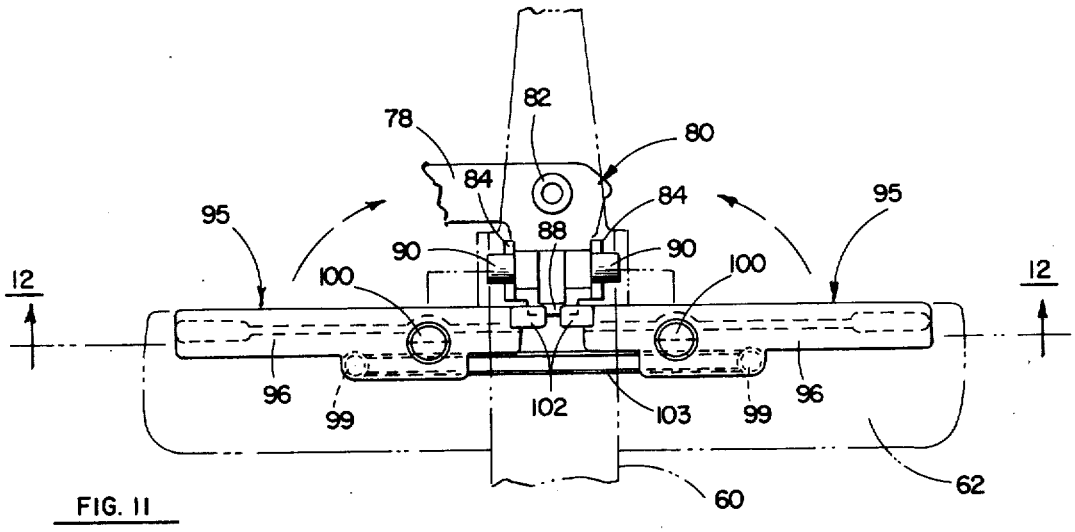
Figure 12:
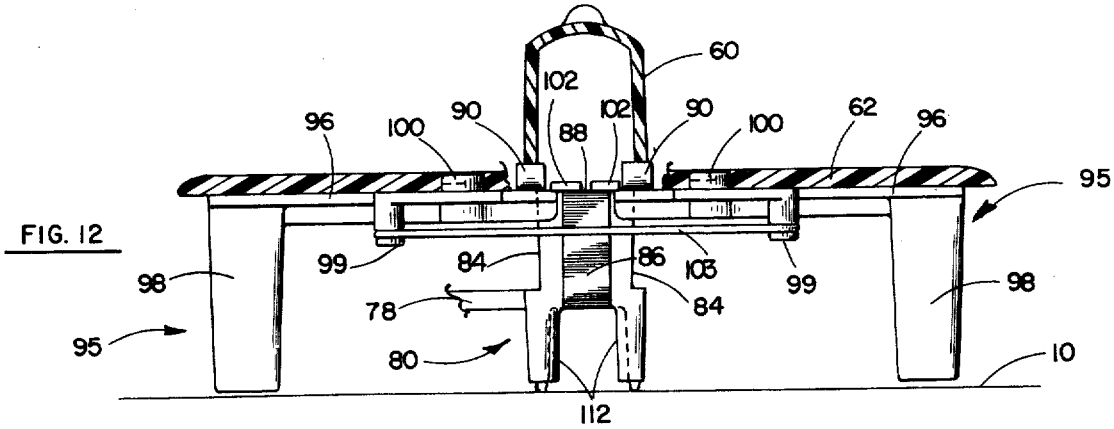

FIG. 6 is a bottom plan view of the projectile deflector mechanism forming part of the apparatus of the present invention;

FIG. 7 is a perspective view, partially shown in dotted lines, of the right hand target used in one of the simulated aircraft forming part of the game apparatus of the present invention;

FIG. 8 is a perspective view showing the projectile deflector mechanism which is used in the game apparatus of the present invention;

FIG. 9 is a vertical fragmentary detailed view somewhat similar to FIG. 3 and showing the actuating portion of the shooting mechanism in an alternate position;

FIG. 10 is a fragmentary side elevational view somewhat similar to FIG. 3, and showing the simulated aircraft in a so-called "crash" position;

FIG. 11 is a fragmentary top plan view, partially broken away, and partially shown in phantom lines, and more fully illustrating target effect means forming part of the apparatus of the present invention; and FIG. 12 is a vertical sectional view taken substantially along the line 12—12 of FIG. 11.

DETAILED DESCRIPTION

Referring now in more detail and by reference characters to the drawings, A designates a simulated aircraft, action-skill game comprising a game board 9 having a top playing surface 10 and an upstanding peripheral side wall 12 which forms a pair of transversely extending, longitudinally opposed player ends 14 and 16, as is more fully illustrated in FIG. 1 of the drawings.

The playing surface 10 is divided by an imaginary transverse midline designated by reference numeral 18 such that the playing surface 10 tapers downwardly toward each of the playing ends 14 and 16 respectively. Each of the opposite transverse ends of the playing surface merge into downwardly U-shaped troughs 20, as are more fully illustrated in FIGS. 2 and 3 of the drawings. In this case, the end sections for each of the player ends 14 and 16, are substantially identical in construction, and therefore, only the right hand end section 16 as illustrated in FIGS. 2 and 3 will be described in further detail herein; although it should be understood that the left hand section is again, identical in construction.

Each of the troughs 20 are defined by a pair of spaced apart transversely extending side walls 22 with a connecting bottom wall 24 and which is tapered downwardly toward a projectile collecting mechanism 26 in the form of a tray 28 having an open upper end for removing the projectiles. In this case, the projectiles are in the form of small steel spherical elements such as small steel balls or the like and are represented by reference numeral 30. However, it should be understood that any form of projectile could be used in accordance with the desired shooting mechanism (as hereinafter described) and in accordance with the present invention.

Located at each of the player ends 14 and 16, and as more fully illustrated in FIGS. 2 and 3 with respect to the player end 16, is a carrier mechanism designated by reference numeral 32. The carrier mechanism 32 in this case comprises a somewhat rectangular housing 34 which is provided with a downwardly extending elongated rectangularly shaped guide rail section 36 which extends within the trough 20 and which thereby enables lateral or transverse movement of the carrier mechanism 32 relative to the game board 9.

The outwardly presented of the side walls 22 integrally merges into an upstanding transversely extending retainer element 38 which engages an outwardly projecting lug 42 on the housing 34. Moreover, the housing 34 is provided with transversely extending, rectangularly shaped portion 36 which guides the housing 34 in its transverse movement within the guide rails 22.

The outwardly most side wall 22 is also provided with a recess 44 and which leads through an inclined plate 46 to the tray 28, in the manner as illustrated in FIG. 3 of the drawings.

Disposed on the upper surface of the housing 34 and extending upwardly therefrom is a control handle 48 which may also be provided with a pistol-grip-like outer surface 50. Extending through the control handle 48 is an actuating rod 52 forming part of shooting mechanism 54, the latter of which is designed to shoot the projectiles 30 at the opposing target in the form of an airplane as hereinafter described. This shooting mechanism will also be described in more detail hereinafter.

Referring again to FIGS. 1–3, it can be observed that the carrier mechanism 32 includes an inwardly extending bracket 56 and operatively mounted on the outer end 57 of the bracket 56 is a three dimensional simulated aircraft 58. In this case, the aircraft is illustrated as a so-called bi-plane, although the aircraft may adopt any form of aircraft. Moreover, and in this particular embodiment, the aircraft includes a fuselage 60 having a lower wing 62 and an upper wing 64, as well as the other attendant components, including horizontal and vertical rear stabilizers 66, a propeller 68 and the like. Pivotally mounted on the underside of the fuselage 60 are a pair of wheel-retaining frames 70, each of which carry wheels 72, in the manner as illustrated in FIGS. 3 and 10 of the drawings. The wheel-retaining frames 70 are pivotally mounted in such manner that they are transversely shiftable outwardly when the simulated aircraft 58 assumes a so-called crash position, that is the position as illustrated in FIG. 10.

Mounted on the control handle 48 is an outwardly extending boss 74 and secured to the boss 74 is a longitudinally extending direction control rod 76, the innermost end of which is secured to an arm 78, as more fully illustrated in FIGS. 2 and 4 of the drawings. The arm 78 is integral with projectile directing mechanism 80, as more fully illustrated in FIGS. 4, 5 and 8 of the drawings. The projectile directing mechanism 80 includes a tubular hub 82 pivotally received in tip portion 57 of carrier bracket 56 and secured by pin 83 to thereby retain the projectile directing mechanism 80 on the outer end of the carrier bracket 56. The projectile directing mechanism 80 also includes a pair of upstanding flanges 84 connected by a connecting wall 86, the latter having an outwardly struck lip 88 for reasons which will presently more fully appear. In addition, the flanges have transversely outwardly extending pins 90 on opposite sides thereof for pivotally mounting the fuselage 60 to the projectile directing mechanism 80. In this case, it can be observed that the aircraft 58 can thereby pivot downwardly to the position as illustrated in FIG. 10 about the pivot pins 90. The projectile directing mechanism 80 further includes an outwardly struck transversely extending arm 78 having an aperture 92 to receive a retaining pin 94, integral with rod 76 and depending therefrom as more fully illustrated in FIG. 4 of the drawings. The target members 95 are provided on each aircraft 58 with a mounting plate 96 which includes a downwardly struck target flap 98. The plate 96 also includes an upwardly struck pin 100 for pivotally securing the target unit to wing 62, as hereinafter described. It can be observed by reference to FIGS. 2 and 3 that the target plate 96 lies beneath one portion of the lower wing 62 and the wing 62 in this case retains a horizontal position through support by the target plate 96. Moreover, and in this case, only the right hand target mechanism is illustrated in FIG. 7. It should be understood that a similar and substantially identical left hand target mechanism would also be employed. Consequently, it can be observed that a pair of transversely spaced apart target flaps 98 are located, each beneath the lower wing 62 on opposite sides of the fuselage 60. This structure is more fully illustrated in FIG. 12 of the drawings.

The target plate 96 also includes at the transverse end opposite the target flap 98 a horizontally extending flange 102 which is capable of engaging lip 88 on the projectile directing mechanism 80. In like manner, the opposite left hand target would also be provided with a flange similar to the flange 102 and which would also engage lip 88.

In accordance with this construction, it can be observed that the simulated aircraft 58 is capable of being held in a vertical position, as illustrated in FIG. 3, and can be pivoted downwardly to the position as illustrated in FIG. 10 on the pins 90. However, the simulated aircraft 58 is held in its horizontal position through engagement of flanges 102 with lip portion 88 of member 80. However, when a projectile hits one of the target flaps 98, it will be propelled rearwardly in the manner as illustrated in FIG. 2 of the drawings, and as illustrated in phantom lines therein. Nevertheless, the simulated aircraft 58 will still remain in its horizontal position inasmuch as it is supported by the target plate 96 of the opposite target. However, when the opposite target flap 98 is struck by a projectile, it will also be propelled rearwardly, disengaging flange 102 thereof so that the simulated aircraft 58 can no longer be maintained in its horizontal position. Consequently, the simulated aircraft 58 will pivot downwardly about the pins 90 to assume the so called crash position, as illustrated in FIG. 10 of the drawings. Moreover, inasmuch as the wheels 72 are retained by the brackets 70 which are pivotally mounted on the fuselage 60, the wheels will also extend transversely outwardly to more fully simulate a crashed aircraft.

Thus, in accordance with the present invention, it can be observed that each of the opponent players will attempt to propel projectiles at the target flaps of the opposite aircraft. In accordance with the game activity, each opponent player will attempt to strike both the target flaps 98, such that the aircraft will assume the crashed position. In this case, the opponent player achieving the two strikes on the target flaps will create a crash position of the opponent player's simulated aircraft, and thereby score a target point. Unlike other forms of target devices, it can be observed that is accordance with the present invention, each player must very carefully shift the simulated aircraft and the shooting mechanism associated therewith, in a manner to be hereinafter described, and issue the necessary projectiles in order to down the opponent's aircraft, that is to achieve a crash position of the opponent's aircraft, before his own aircraft is downed.

Inasmuch as the projectile which strikes the target flap 98 may not have sufficient force to completely shift the plate 96 rearwardly, each plate 96 has a depending pin 99 for interconnection by means of a rubber band 103. In this way, as soon as a particular target flap 98 is struck by a projectile 30, it will tend to move somewhat initially rearwardly, and through the aid of the rubber band 103, it will assume a full rearward position. Nevertheless, it is not necessary to use a rubber band, such as the rubber band 103, and any form of spring biasing mechanism could be employed in connection with the present invention.

As indicated, each of the shooting mechanisms are designed to issue projectiles therefrom. While some of the components of the shooting mechanisms 54 are essentially conventional in their construction, the overall combination thereof and the operation is unique and a brief description of the operating mechanism of the shooting mechanism is described herein. In this case, the actuating rod 52 bears against an ejector 104, as illustrated in FIG. 3 of the drawings, and which includes an ejector spring 106 capable of engaging a projectile ball 30 and propelling the same in a forward direction. As soon as the actuating rod 52 engages the ejector 104, it will push the same about an arc forwardly in order to enable the projectile ball 30 to be projected. Moreover, a restraining lug 108 will shift about an arc in the same direction as the ejector mechanism 104 in order to permit release of the projectile 30.

The carrier bracket 56 is constructed so that it provides a projectile receiving channel 110 in order to receive a projectile which is released by the shooting mechanism 54. In this case, it can be observed that the housing 34 of the carrier mechanism 32 is only shiftable in a transverse direction. However, as indicated previously, the simulated aircraft 58 can be pivoted on the forward end of the bracket 56 by rotation of the handle 48. In this way, when the opponent player rotates the handle 48, the simulated aircraft 58 will also rotate through the action of the rod 76. Thus, and as previously described, while the simulated aircraft 58 will shift transversely with the carrier mechanism 32, and while the carrier mechanism 32 is not pivotal, the simulated aircraft 58 is nevertheless pivotable on the forward end of the bracket 56. Moreover, and as indicated, the carrier bracket 56 forms the channel 110 for receiving the issued projectile 30.

The projectile directing mechanism 80 is also provided with a pair of downwardly struck deflector plates 112, as more fully illustrated in FIGS. 6 and 8 of the drawings. However, it can be observed that as the simulated aircraft 58 is rotated, it is rotated only with the projectile directing mechanism 80. Moreover, the deflector plates 112 will rotate with the projectile directing mechanism 80. In addition, it can be observed by reference to FIG. 3 of the drawings, that the projectile directing mechanism 80 including the deflector plates 112 is located immediately forwardly of the channel 110. Hence, when a projectile 30 is issued from the shooting mechanism 54, it will travel through the channel 110 and will be deflected, and hence guided, toward the opposing aircraft through the deflector plates 112. Moreover, it can be observed that the deflector plates 112 will assume the same pivotal or angulated position as assumed by the aircraft 58. In this way, the player of the game merely rotates the handle 50 in order to rotate his own simulated aircraft 58 to the desired angulated position relative to the game board 10 in a horizontal plane. When his own aircraft assumes the desired angulated position, any projectile issued by actuation of the actuating pin 52 will follow the same trajectory in which the aircraft is pointed. Consequently, if his own aircraft 58 is pointed in the proper direction, the projectile issuing from the shooting mechanism 54 associated with this aircraft will follow a trajectory where it is aligned to strike one of the target flaps 98 of the opponent's simulated aircraft.

Thus, there has been illustrated and described a unique and novel toy aircraft action skill game which meets all of the objects and advantages sought therefor. It should be understood that many changes, modifications, variations and other uses and applications would become apparent to those skilled in the art after considering this specification. Accordingly, any such changes, modifications, variations, and other uses and applications are deemed to be covered by the invention which is limited only by the following claims.

Having thus described our invention, what we desire to claim and secure by letters patent is:

1. An action skill game comprising a. a game board, b. means defining a pair of opposed opponent player ends at each of the opposite ends of said game board, c. carrier means operatively mounted at each of the player ends, d. a simulated three-dimensional aircraft operatively mounted on each of said carrier means and being transversely shiftable and pivotal in a plane normal to said game board, e. a projectile shooting mechanism operatively associated with each said carrier means for issuing a projectile toward the opponent player's simulated aircraft, f. a pair of spaced apart target elements on each said simulated aircraft, and g. target effect means associated with each said simulated aircraft and causing said simulated aircraft to depict a projectile struck aircraft only when both spaced apart target elements on an aircraft have been struck by projectiles issued from the shooting mechanism of the opponent player, said target effect means including means to permit the front end of the simulated aircraft to pivot downwardly toward the game board when both the target elements have been struck by projectiles.

2. The action skill game of claim 1 further characterized in that said projectiles are small metal spherical elements.

3. The action skill game of claim 1 further characterized in that said game board is tapered downwardly toward each of the player ends such that projectiles issued may roll toward either one of the player ends.

4. The action skill game of claim 3 further characterized in that through means are located at back of the player ends to accummulate the spent projectiles.

5. The action skill game of claim 1 further characterized in that said carrier means is shiftable transversely relative to said game board and said simulated aircraft are pivoted normal to said game board on said carrier means.

6. The action skill game of claim 6 further characterized in that shooting mechanism associated with each said carrier means is directionally pivotal with said simulated aircraft associated with such carrier means such that the projectile issuing therefrom is directionally oriented with the simulated aircraft.

7. The action skill game of claim 5 further characterized in that said carrier means include a carrier element extending inwardly from the player ends and that said simulated aircraft is operatively mounted on said carrier element such that the carrier means is transversely shiftable and that said simulated aircraft is pivotal on the innermost proximity of the carrier element.

8. The action skill game of claim 1 further characterized in that wheels are mounted on each of said simulated aircraft and that said wheels pivot outwardly when the front end of said simulated aircraft pivots downwardly.

9. The action skill game of claim 1 wherein each of said shooting mechanisms comprises:

a. frame means, b. a pistol grip-type handle having an elongate section pivotally mounted on said frame means for pivotal movement about an axis extending through said elongate section, c. a spring operated projectile firing mechanism operatively located on said frame means for issuing a projectile therefrom, d. an elongate rod extending through said elongate handle essentially parallel to said axis through said elongate section, and operable upon pressing same to operate said projectile firing mechanism and release said projectile, e. and guide means operatively associated with said frame means and being operatively pivotal with respect to said frame means to direct the projectile in accordance with the pivotal movement of said handle.

10. The projectile shooting mechanism of claim 9 further characterized in that link means operatively connects said handle to said guide means.

11. The projectile shooting mechanism of claim 9 further characterized in that trough means carries said projectile from said frame means to said guide means.

12. The projectile shooting mechanism of claim 9 further characterized in that said frame means comprises:

a. an outer housing having a chamber therein for receiving a projectile, b. an ejector located in said chamber, c. spring means operable by said ejector and engageable with said projectile, d. said elongate rod being an actuating rod capable of being pressed and shifting said ejector from a first position to a second position, and e. restraining means shifting said ejector from a first position to a second position to permit release of said projectile when said restraining means approaches said second position.

13. The projectile shooting mechanism of claim 12 further characterized in that said spring means compresses when said ejector moves from said first position to said second position thereby creating stored energy for transferrence to said projectile when issued.

14. The projectile shooting mechanism of claim 12 further characterized in that said restraining means and ejector are biased from their second position to their first respective positions after issuance of the projectile.

* * * * *